United States Patent [19]

Tsuda

[11] Patent Number: 4,711,064

[45] Date of Patent: Dec. 8, 1987

[54] BINDING APPARATUS FOR SEALING BAGS OR THE LIKE

[75] Inventor: Masaaki Tsuda, Yokohama, Japan

[73] Assignee: Kabushiki Kaisha Takara, Osaka, Japan

[21] Appl. No.: 7,112

[22] Filed: Jan. 27, 1987

[30] Foreign Application Priority Data

Sep. 17, 1986 [JP] Japan ..... 61-219055

[51] Int. Cl.[4] ..... B65B 51/08

[52] U.S. Cl. ..... 53/137; 53/138 A; 53/583; 140/93.6

[58] Field of Search ..... 53/137, 138 A, 583; 140/93 A, 93.6

[56] References Cited

U.S. PATENT DOCUMENTS

| | | | |
|---|---|---|---|
| 3,126,684 | 3/1964 | Bower | 53/583 X |
| 3,354,915 | 11/1967 | Johnson | 140/93 A |
| 3,648,432 | 3/1972 | Zeumer | 53/583 X |
| 4,043,363 | 8/1977 | Tange | 53/583 X |
| 4,087,951 | 5/1978 | Tsuda | 53/583 |
| 4,362,192 | 12/1982 | Furlong | 140/93.6 |

*Primary Examiner*—John Sipos

*Attorney, Agent, or Firm*—Wenderoth, Lind & Ponack

[57] ABSTRACT

A binding apparatus for sealing bags containing any cakes, bread or the like by twisting a ribbon-like plastic-made binding cord or tie on the gathered open end or neck of the bag, with a tag placed under the tie and on the gathered bag neck. This apparatus comprises a bag carrying/gathering means which is a pair of intermittently rotating chains extending parallelly to a bag carrying conveyor; a tie delivering means consisting of a drum having provided on the outer circumference thereof stationary gather receivers and moving tie keep pins, and a pair of swing levers to bend the tie into a reversed U-shape for easy mounting on the gathered neck of the bag; a pushing member to move the swing levers downward and a tie cutter to cut the tie in place to a predetermined length; a tie twisting means to catch and twist the tie on the gathered bag neck and the tag placed in position on the gathers of the bag neck.

4 Claims, 18 Drawing Figures

(A)

(B)

BINDING APPARATUS FOR SEALING BAGS OR THE LIKE

BACKGROUND OF THE INVENTION (1) Field of the Invention

The present invention relates to a binding apparatus for sealing a PVC (polyvinyl chloride) - or PE (polyethylene) -made bag containing cakes, bread or the like by twisting, at a portion near the opening or at the neck portion thereof, a ribbon-like plastic-made binding cord or tie having a core formed axially thereof, with a tag positioned under the tie on the bag near the neck thereof.

(2) Description of the Prior Art

It is well known to use a ribbon-like PVC-made tie having a wire provided axially therein, called "VINI-TIE (trade name)", which is to be twisted on a bag made of PE or the like and which contains cakes, bread or the like, at a portion near the open end or at the neck of the bag in order to seal the bag. Various apparatus of this type have been proposed as disclosed, for example, in the Mrs. Tange's U.S. Pat. No. 4,043,363 and Mr. Tsuda and Mrs. Tange's U.S. Pat. No. 4,087,951. The conventional binding cords or ties have axially provided therein a thin wire which makes the tie itself firm, easy to twist and also prevents the tie from returning to its initial state. The conventional binding apparatus capable of twisting the PVC-made tie is just a combination of a means of supplying a bag into place, means of delivering a tie into place on the bag and a means of twisting the tie around the bag. In this conventional apparatus, since the PVC-made tie has a wire provided therein so that both ends of the tie folded on a bag at the neck thereof is sufficiently firm, the tie can be twisted to a satisfactory extent by a means of catching the tie at the ends thereof, which may take the form of, for example, an S-shaped pawl.

Recently, however, the goods such as cakes, bread or the similar packed in a bag are checked to see if any metallic foreign matter exists therein during the goods inspection in the process of bagging or packaging of this kind. Namely, there is a problem that the wire in such PVC-made tie is detected as a foreign matter at the time of the inspection, so that the bag sealed with such tie is rejected. To avoid such inconvenience in the prior art, a plastic-made binding or tie having formed axially therein a plastic core instead of the wire has been developed for use in the field of packaging or bagging.

However, this plastic-made tie has a high resilience as compared with that of the ties having a fine wire axially provided therein, so that when it is used in the conventional binding apparatus, the binding pawl cannot catch the tie at the ends thereof, resulting in unsuccessful binding or in insufficient twisting of the tie which will slip off the bag neck.

SUMMARY OF THE INVENTION

Accordingly, the present invention has an object to overcome the above-mentioned drawbacks of the conventional technique by providing a binding apparatus capable of securely applying even a plastic-made binding cord or tie without any wire (will be referred to as "tie" hereinafter) to a bag to be sealed, and binding the bag while being held.

The above object can be accomplished by providing a binding apparatus for sealing bags or the like, which comprises, according to the present invention, a bag neck carrying/gathering means composed of a pair of intermittently moving chains each having pushers disposed as regularly spaced and projecting thereon and which are disposed parallelly to a bag carrying conveyor, a tie delivering means having a drum located right under the bag neck gathering position and on the outer circumference of which disposed are stationary gather receivers and moving tie keep pins, and a pair of swing levers to bend the tie into a reversed U-shape at the body of said drum, a pushing member having legs to push down directly said swing levers provided within said drum, and a tie cutter of which the end is forced to the outer circumferential surface of the drum to cut the tie, and a tie twisting means to catch and twist the tie placed right below said tie delivering means and also below said bag neck carrying means.

According to the inventive arrangement described above, the neck of the bag delivered as directed laterally is carried as engaged on and by any of the pushers provided as projecting on the two chains disposed parallelly to the bag carrying conveyor. When the bag neck arrives at the predetermined position where it is to be gathered, it abuts the hook of the gather receiver provided as projecting from the drum outer circumference of the tie delivering means, said drum being intermittently rotated at the position right above the gathering position, and the hook cooperates with one of the pusher to catch and gather the bag neck. An individual tag cut from a tag web is delivered onto the gathers of bag neck, and at the same time the pushing member located within the drum falls down to the gathers. Slice the swing levers in pair on the drum body are pivoted downward as forced between the legs of the pushing member, the tie held on the outer circumferential surface of the drum and which has been cut at a predetermined position is folded into a reversed U-shape and caused to mount on the bag neck gathers on which the tag is placed. At this time, both the ends of this folded tie are guided each into an opening defined by the stationary and moving wings having previously been opened. Thereafter, the moving wing is returned and cooperates with the stationary wing to catch both the tie ends between them. At the same time, the entire shaft portions of these wings are rotated a predetermined number of turns to twist the tie with the tag kept between the gathers and the tie, thereby sealing the bag. After that, the moving wing is opened to release the twisted tie ends from the caught state, and the bag is discharged by the pusher projecting from the outer circumferential surface of the intermittently rotating drum. In this way, one cycle of bag binding or sealing operations is completed.

These and other objects and advantages of the present invention will be better understood from the ensuing description made by way of example with reference to the accompanying drawings.

BRIEF DESCRIPTION OF THE DRAWINGS

The accompanying drawings illustrate the embodiment of the present invention, in which.

DETAILED DESCRIPTION OF THE PREFERRED EMBODIMENTS

Figure 1:
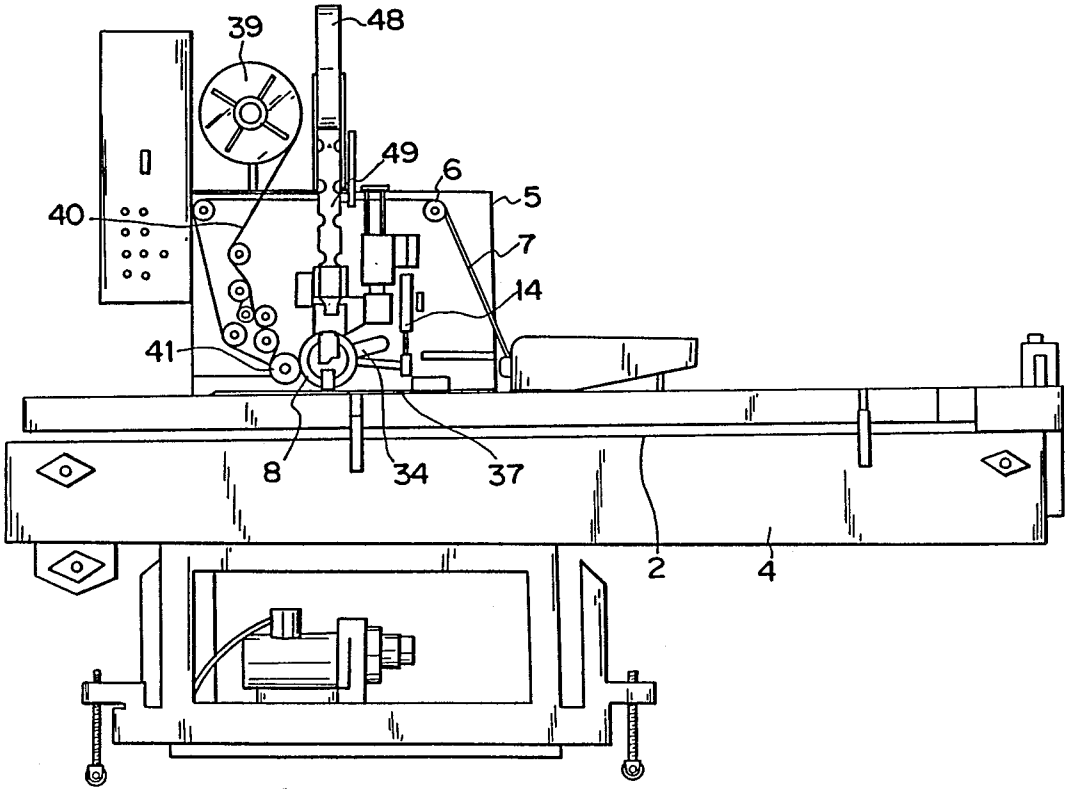
FIG. 1 is a front view of the inventive binding apparatus.
Figure 2:
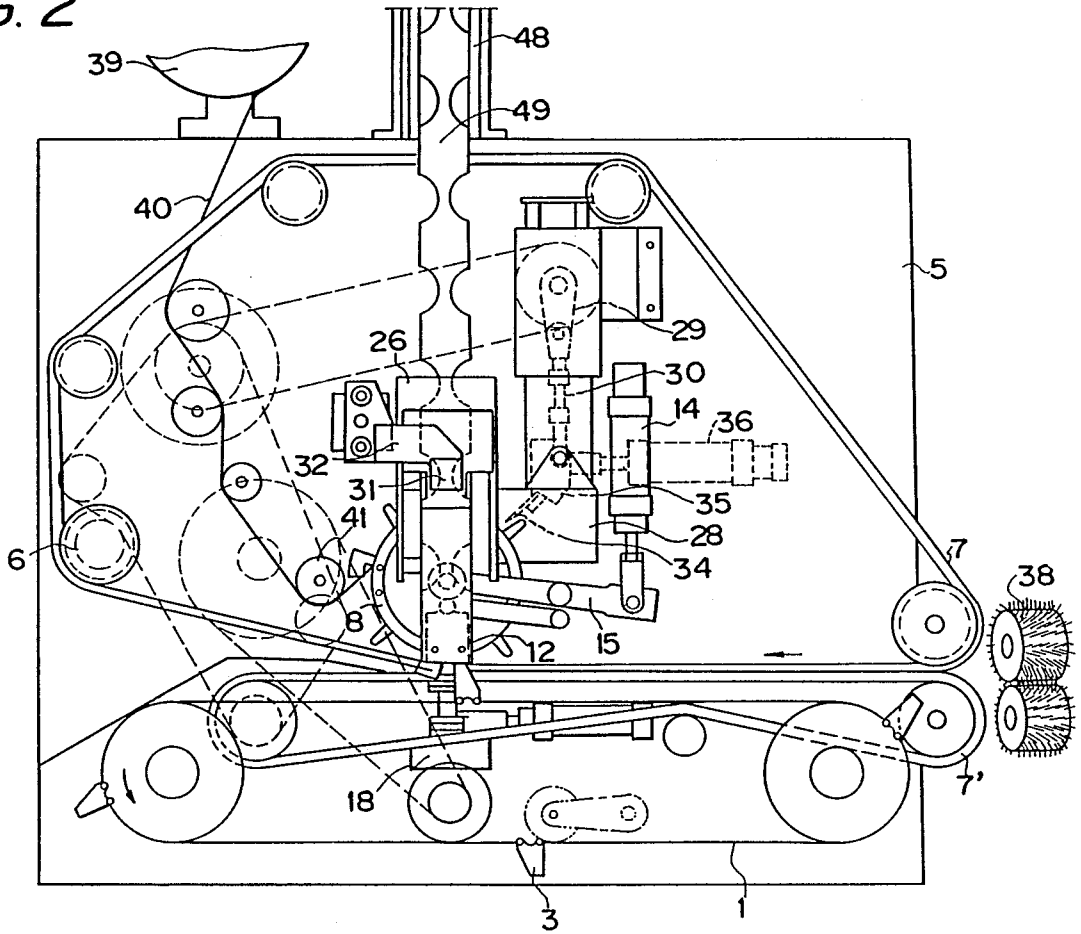
FIG. 2 is also a front view showing the essential mechanism of the apparatus in FIG. 1.
Figure 3:
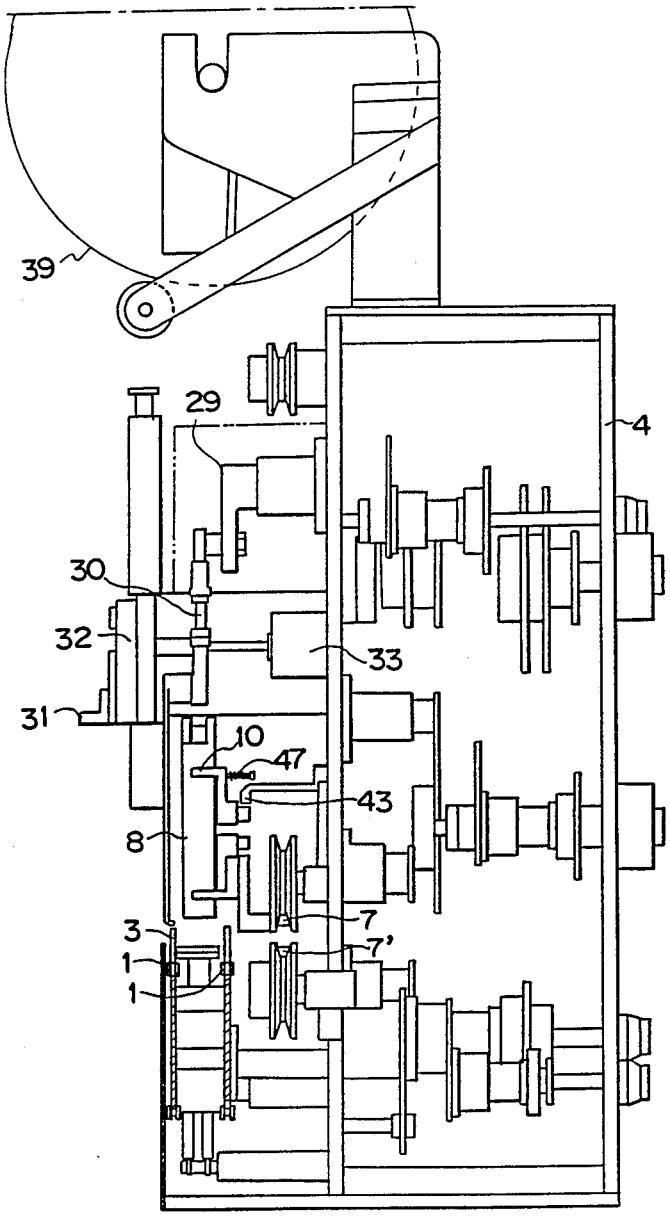
FIG. 3 is a side elevation of the apparatus in FIG. 1.
Figure 4:
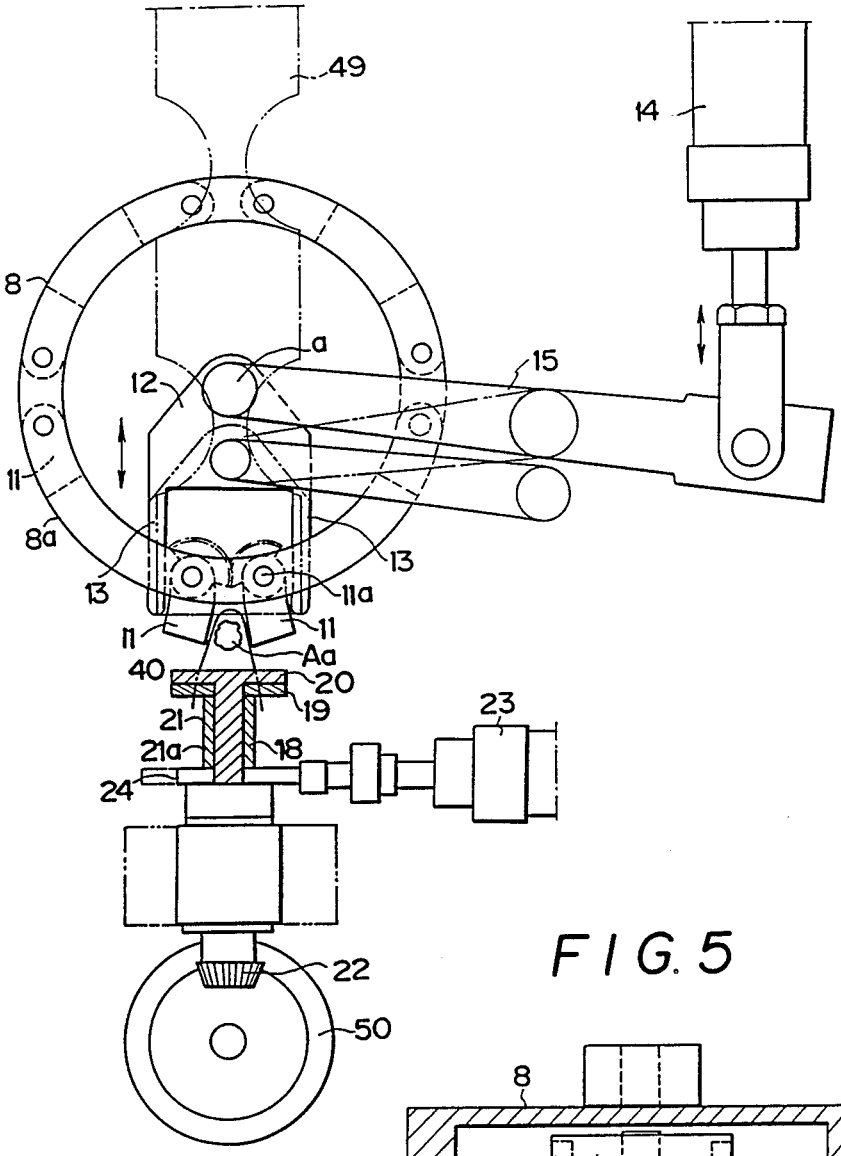
FIG. 4 is an explanatory view of the pushing member and tie twisting means.
Figure 5:
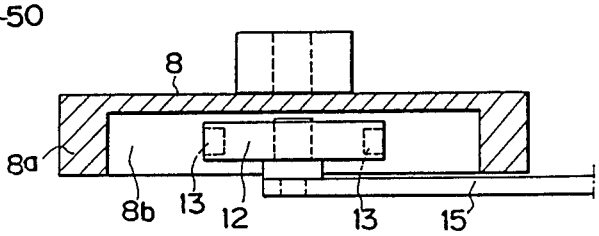
FIG. 5 is a sectional view of the drum.
Figure 6:
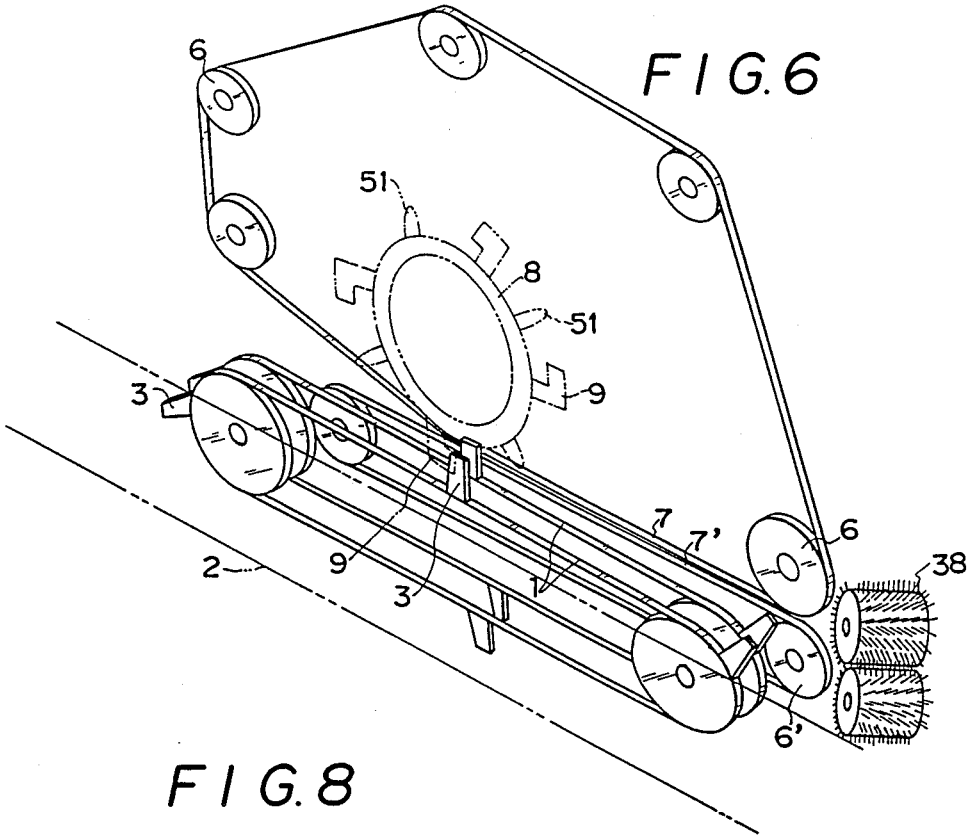
FIG. 6 is a pespective view of the chain and catching belt.
Figure 8:
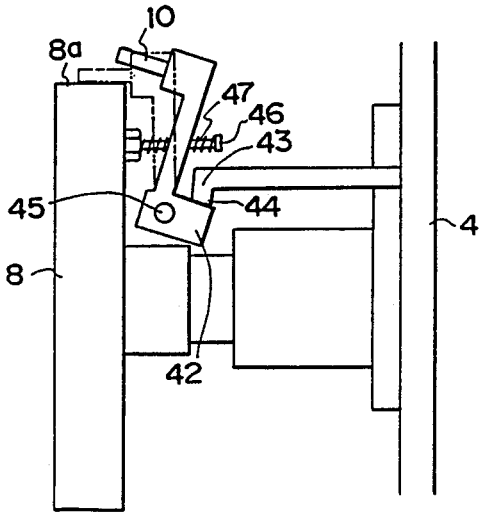
FIG. 8 is a side elevation of the tie keep pin.
Figure 7:
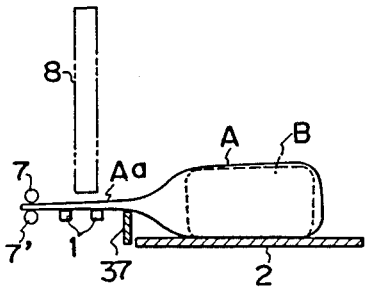
FIG. 7 explains how the bag is supplied into position.
Figure 9:
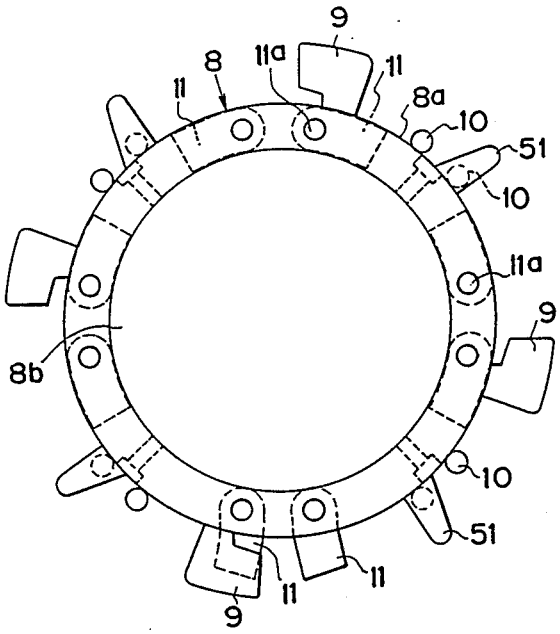
FIG. 9 is a front view of the tie delivering drum.
Figure 10:
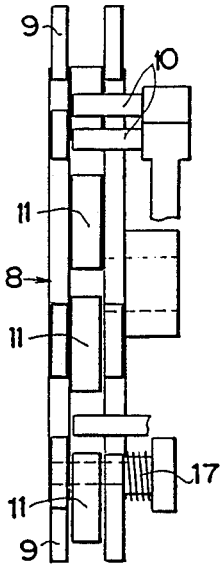
FIG. 10 is a side elevation of the drum in FIG. 9.
Figure 11:
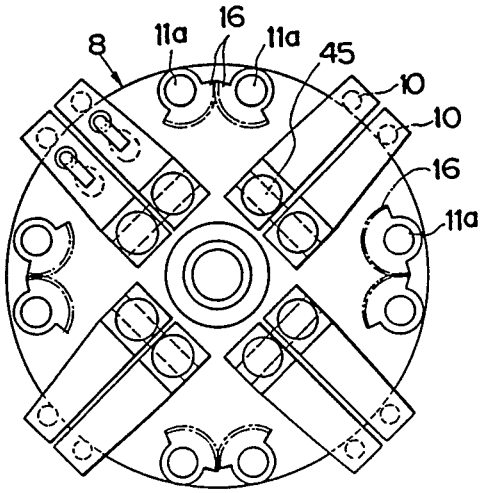
FIG. 11 is a rear view of the drum in FIG. 9.
Figure 12:
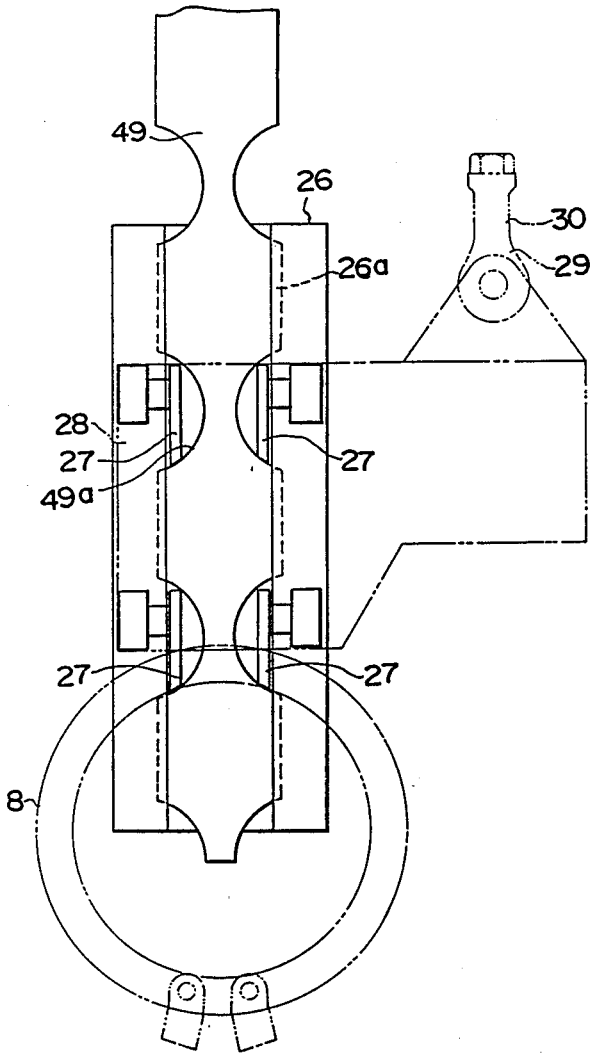
FIG. 12 is a front view of the tag push-down mechanism.
Figure 13:
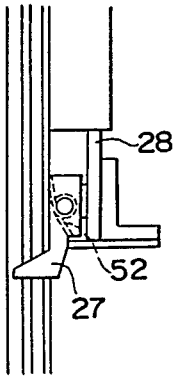
FIG. 13 is a side elevation of the tag push-down mechanism in FIG. 12.
Figure 14:
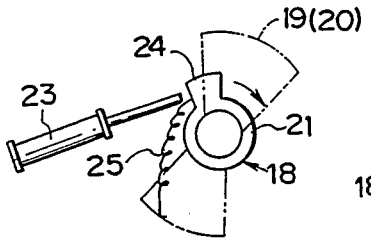
FIGS. 14A, 14B and 14C explain how the stationary and moving wings operate.
Figure 14:
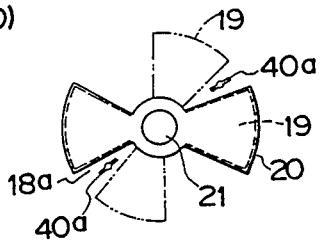
Figure 14:
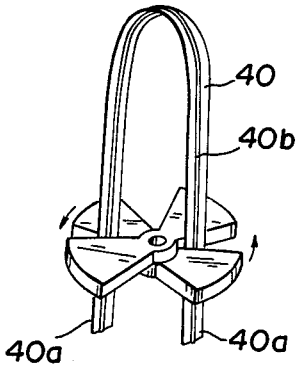
Figure 15:
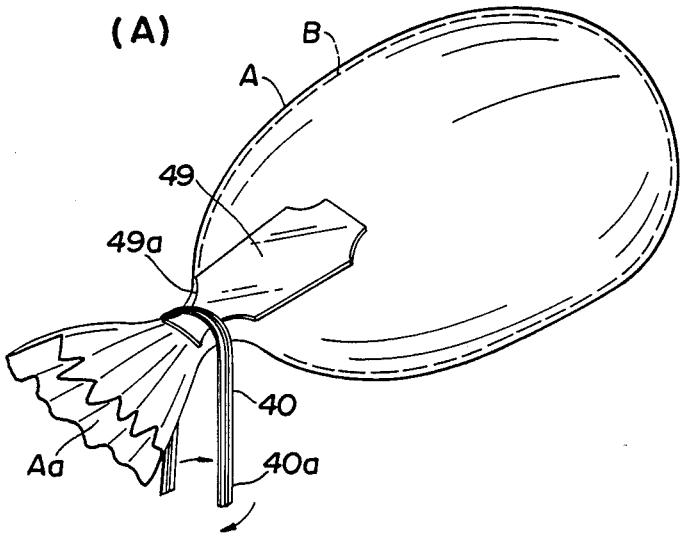
FIGS. 15A and 15B explains the movement of the tie when binding the bag with the tag placed under it.
Figure 15:
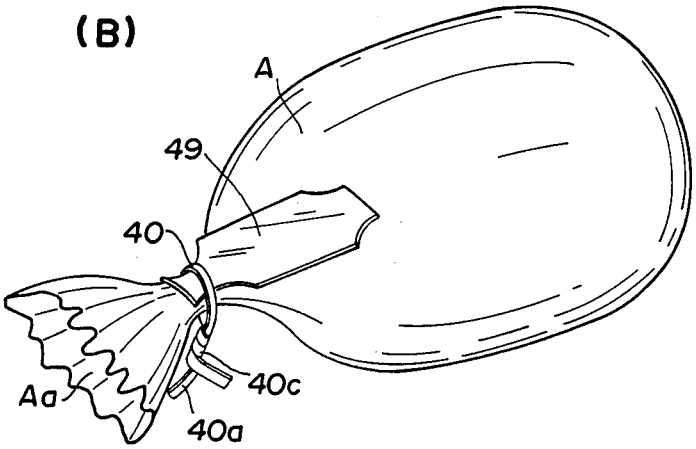

The reference numeral 1 indicates a pair of chains juxtaposed at one side of a bag carrying conveyor 2 composed of a slat conveyor or the like, and which has provided as regularly spaced and projecting thereon projecting bag neck pushers 3. The chains 1 in pair serve as bag neck gathering/bag carrying means. The bag neck is carried and flattened by a pair of upper and lower flattening belts: The upper belt 7 extends on a pluarity of support pullies 6 provided as projecting from a standing support plate 5 located at one side of an apparatus body 4 at one side of the pair of chains 1, and the lower belt 7' is extended on support pullies 6' at the lower portion of the body 4. The reference numeral 8 indicates an intermittently rotating tie delivering drum located below the center of the standing support plate 5 and which has a plurality (4 in number in the illustrated embodimentn) of hook-shaped gather receivers 9 provided as projecting on the outer circumference of the drum and a plurality (8 in number in the illustrated embodiment) of moving tie keep pins 10 free at one side thereof. This drum 8 also has provided therein plural (4 in number in the illustrated embodiment) pairs of tie bending swing levers 11 having the bases thereof pivoted on the drum body **8*a* and which are normally positioned along the outer circumferential surface of the drum 8. These swing levers 11 work as tie delivering means. The reference numeral 12 indicates a member to push the tie bending swing levers 11, having a support point a at the center of a groove 8*b* in the drum 8 and also a pair of legs 13 at the lower end thereof. These legs 13 have the lower ends thereof retreated inside the inner face of the drum body 8*a* when not in operation. Also this pushing member 12 is supported on the end of a link-like lever 15 connected at the base thereof to the lower end of a cylinder 14 fixed to the standing support plate 5, and falls vertically as interlocked with the motion of the cylinder 14. Furthermore, there are provided at the bases of support shafts 11*a* of the swing levers 11 sector gears 16 in mesh with each other to provide a horizontally uniform swing motion of the swing levers 11 and also springs 17 are fitted on the support shafts 11*a* to ensure the return of the swing levers 11 when the pushing member 12 is retreated. The 18 indicates a means of twisting the tie, which is disposed right under the tie delivering drum 8 and also below the chains 1. The tie twisting means 18 comprises a fan-shaped moving wing 19 and a stationary wing 20 disposed as superposed on the moving wing 19. These superposed wings 19 and 20 are rotated as a whole by a bevel gear 22 below a double wing 21 disposed at the lower portion to twist a tie 40 caught at both the ends thereof between the moving and staionary wings 19 and 20. The reference numeral 23 indicates a cylinder which pushes an engaging piece 24 provided as projecting at the end of a shaft 21*a* of the moving wing 19, and the numeral 25 indicates a spring to return the moving wing 19. The reference numeral 26 indicates a tag guide way disposed vertically on the front face of the tie delivering drum 8. This tag guide 26 has disposed at the lower portion thereof a lifting plate 28 provided with a tag push-down pawl 26 at each of the four corners thereof, upper and lower, and right and left, which thus form a tag delivering means. The lifting plate 28 is formed integrally with an actuating rod 30 of a crank mechanism 29 mounted on the standing support plate 5 disposed by the side of the plate 28 and it is movable vertically at predetermined pitches. Also, the tag guide way 26 has provided at the front lower face thereof an orthogonal tag cutting blade 31 which is so arranged as to work as forced by a cylinder 33 disposed on a support plate 32 of the blade 31. The reference numeral 34 indicates a tie cutting blade provided on the lateral side of the tie delivering drum 8 and which is coupled to a cylinder 36 by means of a connecting rod 35**.

The function of the binding apparatus according to the present invention is as follows:

Bags A such as PE-made bag containing any goods B like breads, cakes or the like are put as directed laterally on the bag carrying conveyor 2 and carried one by one to the binding position. At this time, the neck Aa of the bag rides on the guide rail 37 one step higher than the bag carrying conveyor 2 and it is thus held horizontally. Also the neck Aa of the bag A riding on the guide rail 37 passes through between brush rollers 38 disposed obliquely short of the pair of flattening belts 7 and 7', upper and lower, so that the bag neck Aa is flattened before gathered.

Here, the tie 40 drawn out from a tie reel 39 previously set at the top end of the standing support plate 5 is fed via a guide roller 41 and so wound as to go along the outer circumferential surface of the tie delivering drum 8. In this case, the tie keep pins 10 directed laterally with respect to the outer circumferential surface of the drum 8 are opened at the tie lead-in position to lead the tie 40 to the drum 8. The tie keep pin 10 has provided at the base thereof a sliding block 42 which is pivoted around a pin shaft 45 as forced by a displaceable portion 44 of a cam rail 43 disposed as directed outwardly so that the tie keep pins 10 will be opened at one side. The sliding block 42 having passed by the position of the displaceable portion 44 is returned under the resilience of a spring 47 on a bearing shaft 46 disposed at the intermediate portion, catches the tie 40 on the outer circumferential surface of the drum 8 and moves on the outer circumferential surface as the drum 8 rotates intermittently. During this movement, the cutting blade 34 disposed at the lateral side is projected toward the drum 8 as interlocked with the movement of the cylinder 36 and abuts at the free end thereof the face of the drum 8 to cut the tie 40 to a length necessary for one binding. The tie 40 thus cut is intermittently carried to the position right under the drum 8 while being caught on the outer circumferential surface of the drum 8 by the tie keep pins 10.

On the other hand, a web of tags 49 is drawn out from a tag reel 48 mounted on the top of the standing support plate 5, and a tag 49 is fully inserted into the tag recess 26a of a tag guide way 26 disposed on the front face of the drum. The tag 49 is thus guided vertically downward. In the middle of the tag guide way 26, the tag push-down pawls 27 are positioned at the upper and lower constricted portions 49a, respectively, of the tag 49. In this condition, the tag cutting blade 31 is moved under the action of the cylinder 33 to let the tag 49 abut a predetermined portion (under the constricted portion 49a). Thus, a tag 49 is cut from the web. Thereafter, at least the lower tag push-down pawls 27 are pushed down to the bag neck Aa at the lower position, while the projecting cut end of the tag 49, namely, the constricted portion 49a is bent toward the bag end along the gathers of the bag neck Aa. Because of the guide wall existing on the side of the bag body, the constricted portion 49a is so delivered as to naturally turn to the bag neck.

Since the hook-shaped gather receiver 9 stands by right under the drum 8 when the neck Aa of the bag comes beneath the drum 8, the bag neck is gathered as forced by the gather receiver 9 and the bag neck pusher 3 provided as projecting from the chain 1. The gathers thus formed is suitable for binding. Thereafter, the pushing member 12 disposed inside the drum 8 comes down, and the legs 13 of the member 12 cause both the ends of the pair of swing levers 11 built in the drum body 8a to project downward as pivoted. So the tie 40 of a predetermined length along the outer circumference will have both the ends thereof slipped off against the retention by the tie keep pins 10 and it be bent into a reversed U-shape. Thus the tie 40 mounts on the gathered neck Aa located at the lower position. As the moving wing 19 normally superposed on the stationary wing 20 of the tie twisting means 18 is pushed at the engaging portion 24 integral therewith by the extension of the cylinder 23, it moves and forms together with the staionary wings 20 an opening 18a into which both ends 40a of the tie 40 are taken. Thereafter, the cylinder 23 is retreated, and the moving wing 19 is returned under the action of the return spring 25 to retain both ends 40a of the tie 40.

After that, a face gear 50 rotates and the entire tie twisting means 18 is rotated by means of the bevel gear 22 in mesh with the face gear 50 so that the tie will be twisted. Then, the cylinder 23 works again so that an opening 18a is defined between the moving wing 19 and stationary wing 20. Thus both the ends 40a of the tie 40 are released. As the tie deliveing drum 8 rotates intermittently for a next binding, the bag A having been sealed by the preceding binding is discharged as moved forwardly by the pushers 51 provided as projecting from the outer circumferential surface of the drum 8. In this case, the twisted portion 40c of the tie 40 once twisted on the bag neck Aa is not loosend since the tie has a rib 40b formed axially thereof in order to impart a firmness to the tie 40. Because of the rib 40b, the tie 40 will not droop more than necessary when bent into a reversed U-shape by the swing levers 11, so that the ends of the tie 40 will positively enter the openings 18a, respectively, as the swing levers 11 are pivoted. In the drawing, the reference numeral 52 indicates a push spring provided at the shaft of the tag push-down pawl 27 and which lets the pawl end enter the tap guide way 26 and touch the shoulders of the constricted portion 49a when the pawl is moved down, and also lets the pawl end ride on the surface of the tag 49 when the pawl is raised.

As having been described in the foregoing, the binding apparatus for sealing the bags or the like according to the present invention has the bag carrying conveyor on which the necks of the bags are placed as directed laterally. At one side of the conveyor, the pair of chains is disposed on which the bag neck pushers are provided as projecting. Right above these chains, there are provided the drum-like tie delivering means and the pushing member having provided as projecting the legs which actuate the swing levers. The pushing member is located within the tie delivering means, and the swing levers bend the tie on the drum outer circumference into the reversed U-shape. Further there are provided the tag push-down means, and tie twisting means located under the chain and which is composed of the moving and stationary wings. Because of this arrangement, bags and their necks are securely carried into place, and the bag necks are positively gathered between the bag neck pushing pawl and the gather receiver on the drum. Since the tie is delivered as wound along the drum and tie keep pins are provided in positions (before and after a predetermined length of one tie) to retain the tie, the tie can be securely carried into place. Also since the tie is forcibly bent and put onto the gathers of the bag neck by the swing levers which are moved as interlocked with the motion of the legs of the pushing member within the drum, the tie, even if it contains no wire, can be positively bent into a reversed U-shape. Further, since the tie is twisted with its both ends thereof caught between the two wings, moving and stationary, the twisting can be made positively with a large force. Also the rib of the tie itself also acts to provide a twisting which incurs no return.

Furthermore, the tie is cut directly from above along the outer circumferential surface of the drum and both ends of the tie thus cut to a predetermined length are securely caught between the movable tie keep pins, so that even any tie which is not so firm can be delivered precisely to the position right under the bag neck. Also, since the tag is moved down at a single stroke over a predetermined pitch by the four tag push-down pawls of which the ends rest on the upper and lower constricted portions of the tag, the single tag separated from the tag web is guided securely onto the gathered bag neck without being bent on the way. The tag thus delivered into place can be effectively secured to the bag neck with the tie.

I claim:

1. A binding apparatus for sealing the bags or the like, comprising:

bag carrying/gathering means composed of a pair of intermittently moving chains each having pushers disposed as regularly spaced and projecting thereon and which are disposed parallelly to a bag carrying conveyor;

tie delivering means having a drum located right above said bag neck gathering position and on the outer circumference of which disposed are stationary gather receivers and moving tie keep pins, and a pair of swing levers to bend the tie into a reversed U-shape at the body of said drum;

a pushing member having legs to push down directly said swing levers provided within said drum, and a tie cutter of which the end is forced to the outer circumferential surface of the drum to cut the tie; and tie twisting means to catch and twist the tie placed right below said tie delivering means and also below said bag neck carrying means.

2. A binding apparatus for sealing the bags or the like comprising: bag carrying/gathering means composed of an intermittently moving chain having pushers disposed as regularly spaced and projecting thereon and which are positioned parallelly to a bag carrying conveyor;

tie delivering means having a drum located right above said bag neck gathering position and on the outer circumference of which disposed are stationary gather receivers and moving tie keep pins, and a pair of swing levers to bend the tie into a reversed U-shape at the body of said drum;

a pushing member having legs to push down directly said swing levers provided within said drum, and a tie cutter of which the end is forced to the outer circumferential surface of the drum to cut the tie;

tag push-down means provided in a tag guid way disposed on the front side of said drum and which has four push-down pawls, upper and lower, and right and left, to push down the constricted portions of a tag, and a tag cutter provided on the front side of said tag push-down means; and tie twisting means to catch and twist the tie placed right below said tie delivering means and also below said bag neck carrying means.

3. An apparatus according to claim 2, in which said tie twisting means comprises a fan-shaped moving wing and a fan-shaped stationary wings superposed on said moving wing, these moving and stationary wings being so arranged to be rotated together by a bevel gear disposed at a lower position so that the tie caught between them is twisted several turns.

4. An apparatus according to claim 2, in which said tag push-down means is so arranged that a tag is delivered into place by a lifting plate having provided thereon tag push-down pawls which are applied at the constricted portions, upper and lower, and right and left, respectively, of the tag to push down the tag along the tag guide way and by an actuating rod of a crank mechanism connected to said lifting plate and which can move the latter vertically.

* * * * *